US010607563B2

(12) United States Patent
Kim et al.

(10) Patent No.: US 10,607,563 B2
(45) Date of Patent: Mar. 31, 2020

(54) DISPLAY DEVICE AND METHOD OF DRIVING THE SAME

(71) Applicant: SAMSUNG DISPLAY CO., LTD., Yongin-si, Gyeonggi-do (KR)

(72) Inventors: Dong In Kim, Suwon-si (KR); Jin Kyu Park, Seoul (KR); Yo Han Lee, Asan-si (KR); Ki Hoon Choi, Cheonan-si (KR); Hyun Seok Hong, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 629 days.

(21) Appl. No.: 15/432,359

(22) Filed: Feb. 14, 2017

(65) Prior Publication Data

US 2018/0061362 A1 Mar. 1, 2018

(30) Foreign Application Priority Data

Aug. 23, 2016 (KR) ..... 10-2016-0106906

(51) Int. Cl.

| | |
|---|---|
| ***G09G 5/00*** | (2006.01) |
| ***G09G 5/28*** | (2006.01) |
| ***G09G 5/32*** | (2006.01) |
| *G09G 3/20* | (2006.01) |

(52) U.S. Cl.

CPC ..... *G09G 5/003* (2013.01); *G09G 5/28* (2013.01); *G09G 5/32* (2013.01); *G09G 3/2096* (2013.01); *G09G 2300/0413* (2013.01); *G09G 2310/061* (2013.01); *G09G 2310/08* (2013.01); *G09G 2320/0223* (2013.01); *G09G 2370/08* (2013.01)

(58) Field of Classification Search

CPC ..... G09G 5/003; G09G 2300/0413; G09G 2310/061; G09G 2310/06; G09G 2310/08; G09G 3/2096; G09G 2320/0223

See application file for complete search history.

(56) References Cited

U.S. PATENT DOCUMENTS

| | | | | |
|---|---|---|---|---|
| 7,948,465 | B2 | 5/2011 | Cho et al. | |
| 9,240,159 | B2 | 1/2016 | Na et al. | |
| 2010/0134401 | A1* | 6/2010 | Shin | G09G 3/3611 345/99 |
| 2010/0156885 | A1* | 6/2010 | Cho | G09G 3/006 345/214 |
| 2017/0285793 | A1* | 10/2017 | Shamarao | G06F 3/044 |

FOREIGN PATENT DOCUMENTS

KR 10-2010-0073718 A 7/2010

* cited by examiner

*Primary Examiner* — William Boddie
*Assistant Examiner* — Saifeldin E Elnafia
(74) *Attorney, Agent, or Firm* — Lewis Roca Rothgerber Christie LLP

(57) ABSTRACT

A display device includes a timing controller, a driver, and a display panel. The timing controller outputs a first clock signal having first rising time during an active section and a second clock signal having second rising time during a blank section adjacent to the active section. The driver generates a data signal based on the first clock signal and the second clock signal and to output the data signal. The display panel displays an image based on the data signal. The first rising time is shorter than the second rising time.

20 Claims, 19 Drawing Sheets

1st frame
2nd frame
110
120
110
120
TD
vertical active section
vertical blank section
vertical active section
vertical blank section
kth row
horizontal active section
horizontal blank section
TD
110
120

DISPLAY DEVICE AND METHOD OF DRIVING THE SAME

CROSS-REFERENCE TO RELATED APPLICATION

Korean Patent Application No. 10-2016-0106906, filed on Aug. 23, 2016, and entitled, "Display Device and Method of Driving the Same," is incorporated by reference herein in its entirety.

BACKGROUND

1. Field

One or more embodiments described herein relate to a display device and a method for driving a display device.

2. Description of the Related Art

Various types of displays have been developed. Examples include a liquid crystal displays and an organic light emitting displays. A liquid crystal display includes a liquid crystal layer between substrates that respectively include pixel and common electrodes. When voltages are applied to the electrodes, an electric field is generated to control the alignment of liquid crystal molecules in the liquid crystal layer, This, in turn, controls light emission for displaying an image.

An organic light emitting display generates an image using an organic luminescent material that emits light based on a recombination of electrons and holes in an organic layer. Organic light emitting displays have high response speed, high brightness, a wide viewing angle, and low power consumption.

SUMMARY

In accordance with one or more embodiments, a display device includes a timing controller to output a first clock signal having first rising time during an active section and a second clock signal having second rising time during a blank section adjacent to the active section; a driver to generate a data signal based on the first clock signal and the second clock signal and to output the data signal; and a display panel to display an image based on the data signal, wherein the first rising time is shorter than the second rising time. The slew rate of the first clock signal may be greater than the slew rate of the second clock signal.

The first clock signal may have first falling time, the second clock signal may have second falling time, and the first falling time may be shorter than the second falling time. The first clock signal may have a first maximum voltage and a first minimum voltage lower than the first maximum voltage, the second clock signal may have a second maximum voltage and a second minimum voltage lower than the second maximum voltage, the first maximum voltage may have lower than the second maximum voltage, and the first minimum voltage may have lower than the second minimum voltage.

The display panel may include a display area to display an image and a non-display area outside the display area. The display area may include 1st to nth pixel rows (n is a natural number of 2 or more), and the active section may have a vertical active section in which the data signal is input to the 1st to nth pixel rows. The display area may include 1st to nth pixel columns (n is 2 or more), and the active section may include a horizontal active section in which the data signal is input to the 1st to nth pixel columns.

The timing controller may change the first rising time to generate the second clock signal when the active section is converted to the blank section. The timing controller may include a first output and a second output connected with the driver, the first output may provide the first clock signal to the driver during the active section, and the second output may provide the second clock signal to the driver during the blank section.

In accordance with one or more other embodiments, a display device includes a display panel including a display area to display an image and a non-display area outside the display area; a driver connected with the display panel through a plurality of signal lines; and a time controller to provide a first clock signal to the driver during an active section and a second clock signal to the driver during a blank section adjacent to the active section, wherein the driver is to provide a data signal generated based on the first clock signal and the second clock signal to the signal lines during the active section, and wherein the slew rate of the first clock signal is greater than the slew rate of second clock signal.

The rising time of the first clock signal may be shorter than the rising time of the second clock signal. The driver may provide a dummy data signal generated based on the first clock signal and the second clock signal to the non-display area during the blank section. The display area may include 1st to nth pixel rows (n is a natural number of 2 or more), and the active section may be a vertical active section in which the data signal is input to the 1st to nth pixel rows.

The display area may include 1st to nth pixel columns (n is a natural number of 2 or more), and the active section may be a horizontal active section in which the data signal is input to the 1st to nth pixel columns. The timing controller may adjust the slew rate of the first clock signal to generate the second clock signal when the active section is converted to the blank section.

The timing controller may include a first output and a second output connected with the driver, the first output may provide the first clock signal to the driver during the active section, and the second output may provide the second clock signal to the driver during the blank section. The first clock signal may have a first maximum voltage and a first minimum voltage lower than the first maximum voltage, the second clock signal may have a second maximum voltage and a second minimum voltage lower than the second maximum voltage, the first maximum voltage may be lower than the second maximum voltage, and the first minimum voltage may be lower than the second minimum voltage.

In accordance with one or more other embodiments, a method for driving a display device includes providing a first clock signal having a first rising time to a driver during an active section in which a data signal displaying an image is input; and providing a second clock signal having a second rising time to the driver during a blank section located adjacent to the active section, wherein the first rising time is shorter than the second rising time. The slew rate of the first clock signal may be greater than the slew rate of the second clock signal.

The first clock signal may have a first maximum voltage and a first minimum voltage lower than the first maximum voltage, the second clock signal may have a second maximum voltage and a second minimum voltage lower than the second maximum voltage, the first maximum voltage may be lower than the second maximum voltage, and the first minimum voltage may be lower than the second minimum voltage.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
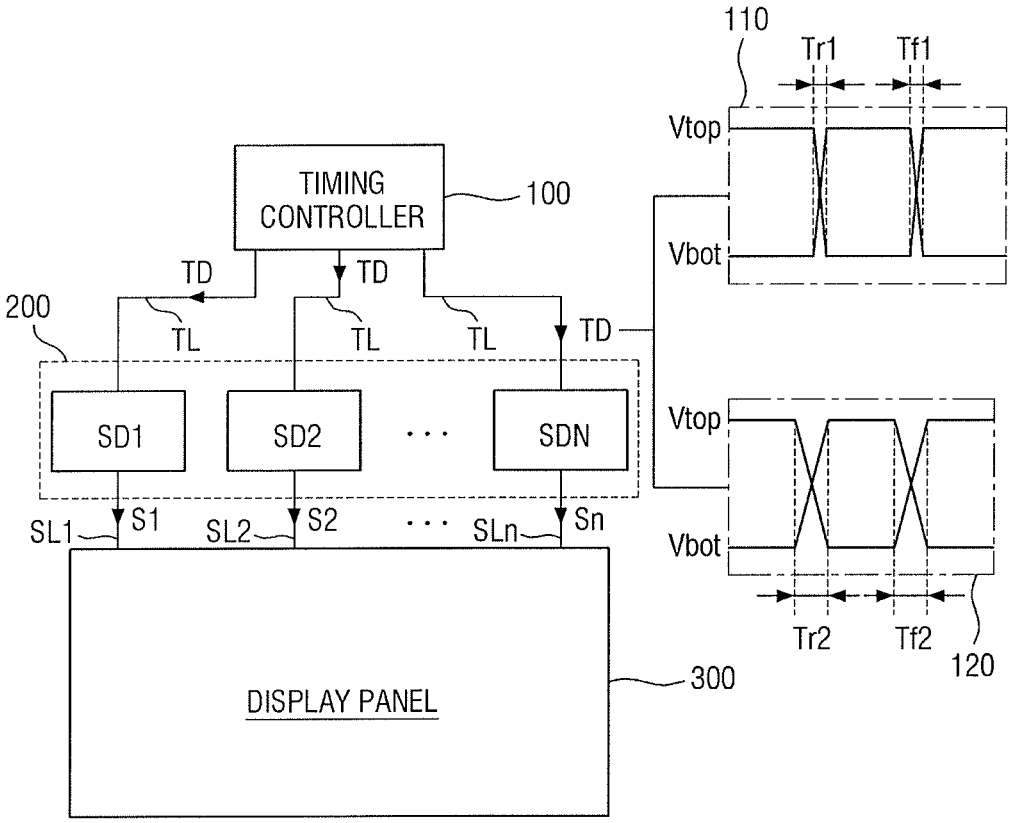
FIG. 1 illustrates an embodiment of a display device.

Example embodiments will be described with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments (or portions thereof) may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of a display device which may be, for example, a liquid crystal display device, an organic light-emitting display device, a field emission display device, or a plasma display device.

Referring to FIG. 1, the display device may include a timing controller 100, a drive circuit unit 200, and a display panel 300. The timing controller 100 may provide transmission data TD through a plurality of first signal lines TL. The transmission data TD may include a first clock signal 110 and a second clock signal 120. The transmission data TD may further include a control signal for controlling the operation of the drive circuit unit 200 along with the first clock signal 110 and the second clock signal 120.

The timing controller 100 may externally receive raw video signals (e.g., RGB signals), a vertical synchronization signal Vsync, and a horizontal synchronization signal Hsync. The timing controller 100 may generate transmission data TD based the externally received signals and may output the generated transmission data TD to the drive circuit unit 200.

The first clock signal 110 may have first rising time Tr1 and first falling time Tf1. The rising time may correspond to the time taken for a voltage level to rise from a first (e.g., minimum or other predetermined) voltage to a second (e.g., maximum or another predetermined) voltage in a clock signal having a predetermined section. The falling time may correspond to the time taken for the voltage level to fall from the first voltage to the second voltage in the clock signal having a predetermined section. In one embodiment, the first rising time Tr1 corresponds to the time taken for the first clock signal 110 to rise from the minimum voltage Vbot to the maximum voltage Vtop. Further, the first clock signal 110 may include display data DD.

The second clock signal 120 may have second rising time Tr2 and second falling time T12. The first rising time Tr1 is shorter than the second rising time Tr2. For example, the voltage level of the first clock signal 110 may rapidly change from the minimum voltage Vbot to the maximum voltage Vtop, compared to that of the second clock signal 120.

The first clock signal 110 has a higher slew rate than the second clock signal 120. The slew rate may correspond to the degree to which a pulse waveform increases to a predetermined (e.g., maximum) value over a predetermined time. In one embodiment, slew rate may be represented as the slope or inclination of the waveform as it increases to the maximum value. Slew rate may be determined, for example, as a value obtained by dividing the rising voltage by the rising time.

The slew rate of the first clock signal 110 may be represented, for example, as a value obtained by dividing the voltage change from the minimum voltage Vbot to the maximum voltage Vtop by the first rising time Tr1. The slew rate of the second clock signal 120 may be represented, for example, as a value obtained by dividing the voltage change from the minimum voltage Vbot to the maximum voltage Vtop by the second rising time Tr2. Since the first rising time Tr1 is shorter than the second rising time Tr2, the slew rate of the first clock signal 110 is higher than the slew rate of the second clock signal 120.

The first falling time Tf1 is shorter than the second falling time Tf2. For example, the voltage level from the minimum voltage Vbot to the maximum voltage Vtop is changed so that the first clock signal 110 is rapid compared to the second clock signal 120.

The timing controller 100 may provide the first clock signal 110 to the drive circuit unit 200 during an active section. The timing controller 100 may provide the second clock signal 120 to the drive circuit unit 200 during a blank section. The active section may correspond to a section during which display data DD, for displaying an image in the corresponding frame, is input. The blank section may correspond to a section during which display data DD, for displaying an image in the corresponding frame, is not input. The active section may include, for example, a vertical active section VA and a horizontal active section HA. The blank section may include a vertical blank section VB and a horizontal blank section HB.

The vertical active section VA and horizontal active section HA are adjacent to each other in one frame. Further, one vertical active section VA may include a plurality of horizontal active sections HA and a plurality of horizontal blank section HB.

The timing controller 100 may provide the first clock signal 110 to the drive circuit unit 200 during the vertical active section VA, and may provide the second clock signal 120 to the drive circuit unit 200 during the vertical blank section VB located next the vertical active section VA. In an embodiment, the timing controller 100 may generate the second clock signal 120 having the second rising time Tr2 longer than the first rising time Tr1 by changing the length of the first rising time Tr1 of the first clock signal 110.

The drive circuit unit 200 may be connected with the timing controller 100 through a plurality of first signal lines TL. The drive circuit unit 200 may be connected with the display panel 300 through a plurality of second signal lines SL1 to SLn. The drive circuit unit 200 may provide display signals S1 to Sn to the display panel 300 through the plurality of second signal lines SL1 to SLn.

In an embodiment, the drive circuit unit 200 may be, for example, a data integrated circuit (IC) that provides data signals to the display panel 300. The data signals may be signals including display data DD for display an image for the display panel 300. The second signal lines SL1 to SLn may be data lines receiving the data signals. The display signals S1 to Sn may be the data signals. The drive circuit unit 200 may include a plurality of source drivers SD1 to SDn. Each of the source drivers SD1 to SDn may be connected with the timing controller 100 through the first signal line TL in a point-to-point manner.

In another embodiment, the drive circuit unit 200 may be a scan drive unit providing a plurality of scan signals to the display panel 300. The display panel 300 includes a plurality of pixel units. The pixel units may include a switching element receiving data signals for display an image and a pixel electrode receiving the data signals through the switching operation of the switching element. The plurality of scan signals may be signals provided to a control electrode of the switching element to control the switching operation. The second signal lines SL1 to SLn may be a plurality of scan lines receiving the scan signals. Further, the display signals S1 to Sn may be the scan signals. In an embodiment, the drive circuit unit 200 may include a shift register. Unlike FIG. 1, the shift register may be connected with the timing controller 100 through one signal line.

At least some embodiments are described assuming that the drive circuit unit 200 is a data drive unit and the display signals S1 to Sn output from the drive circuit unit 200 are data signals.

Figure 2:
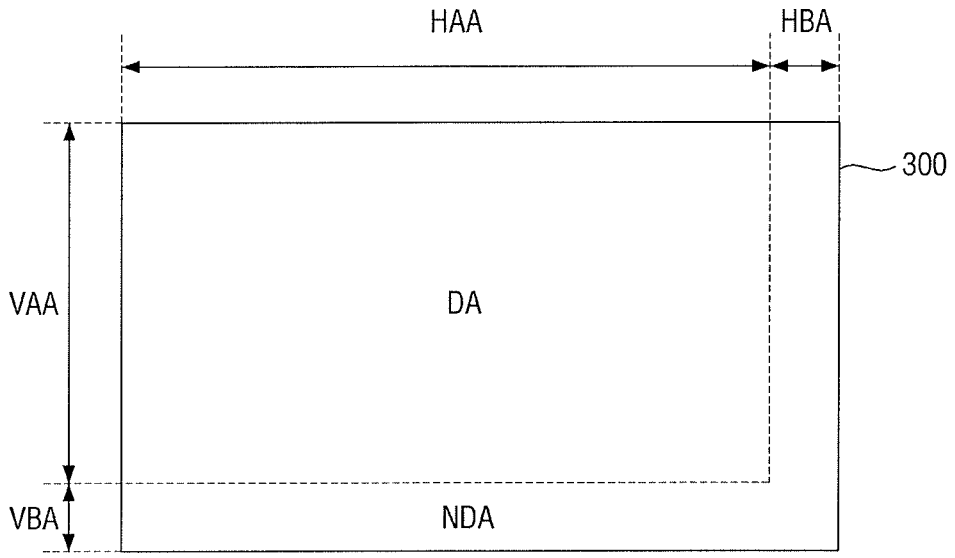
FIG. 2 illustrates an embodiment of a display panel.

The display panel 300 may display an image based on the display signals S1 to Sn from the drive circuit unit 200. The display panel 300 may be, for example, a liquid crystal display panel, an organic light-emitting display panel, or a plasma display panel. FIG. 2 illustrates an embodiment of the display panel 300 in FIG. 1. Referring to FIGS. 1 and 2, the display panel 300 may include a display area DA and a non-display area NDA. The display area DA may display an image. The display area DA may include scan lines, data lines, and pixel units. The non-display area NDA may not display an image. The non-display area NDA may include dummy scan lines, dummy data lines, and dummy pixel units. The non-display area NDA may not include at least one of the dummy scan lines, dummy data lines, or dummy pixel units. The non-display area NDA may be outside the display area DA. The display and non-display areas may have a different configuration in another embodiment.

The pixel units may be arranged in a matrix of 1 to n rows (n is a natural number of 2 or more) and 1 to m columns (m is a natural number of 2 or more). The dummy pixel units may be arranged in one or more rows and one or more columns.

The pixel units in the 1 to n rows may be arranged along a vertical active area VAA. For example, the display signals S1 to Sn provided during the vertical active section VA may be provided to the pixel units composed of 1 to n rows arranged along the vertical active area VAA. The display signals S1 to Sn provided during the vertical active section VA may be signals generated based on the first clock signal 110.

The dummy pixel units in the one or more rows may be arranged along the vertical blank area VBA. The display signals S1 to Sn provided during the vertical blank section VB may be provided to the dummy pixel units in one or more rows arranged along the vertical blank area VBA. The display signals S1 to Sn provided during vertical blank section VB may be generated based on second clock signal 120.

The pixel units in the 1 to m columns may be arranged along a horizontal active area HAA. The display signals S1 to Sn provided during the vertical active section VA may be provided to the pixel units composed of 1 to m columns arranged along the horizontal active area HAA. The display signals S1 to Sn provided during the horizontal active section HA may be generated based on the first clock signal 110.

The dummy pixel units in one or more columns may be arranged along the horizontal blank area HBA. The display signals S1 to Sn provided during the horizontal blank section HB may be provided to the dummy pixel units in one or more columns arranged along the horizontal blank area HBA. The display signals S1 to Sn provided during the horizontal blank section HB may be generated based on the second clock signal 120.

Figure 3:
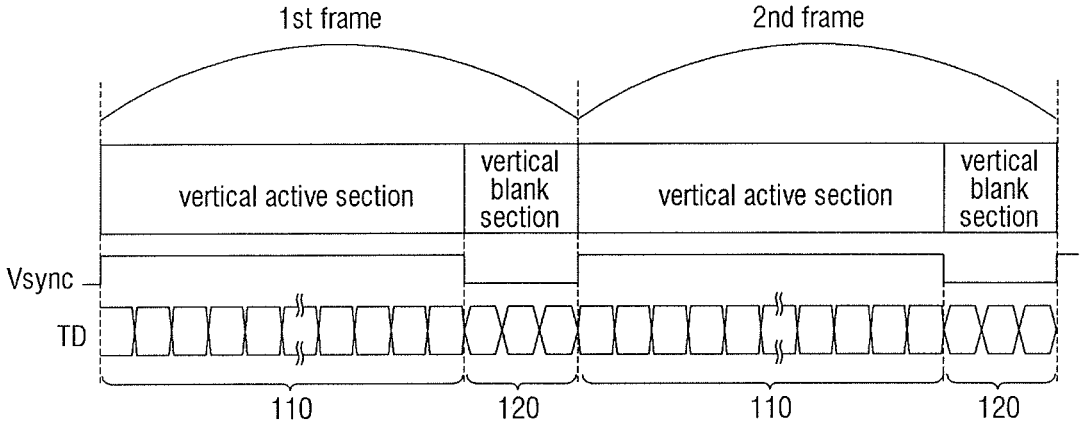
FIG. 3 illustrates an embodiment of a signal transmission method.
Figure 4:
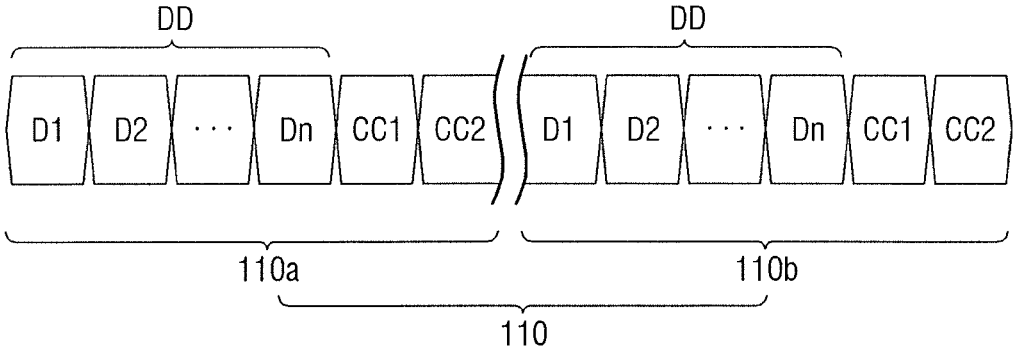
FIG. 4 illustrates an example of a first clock signal.
Figure 5:
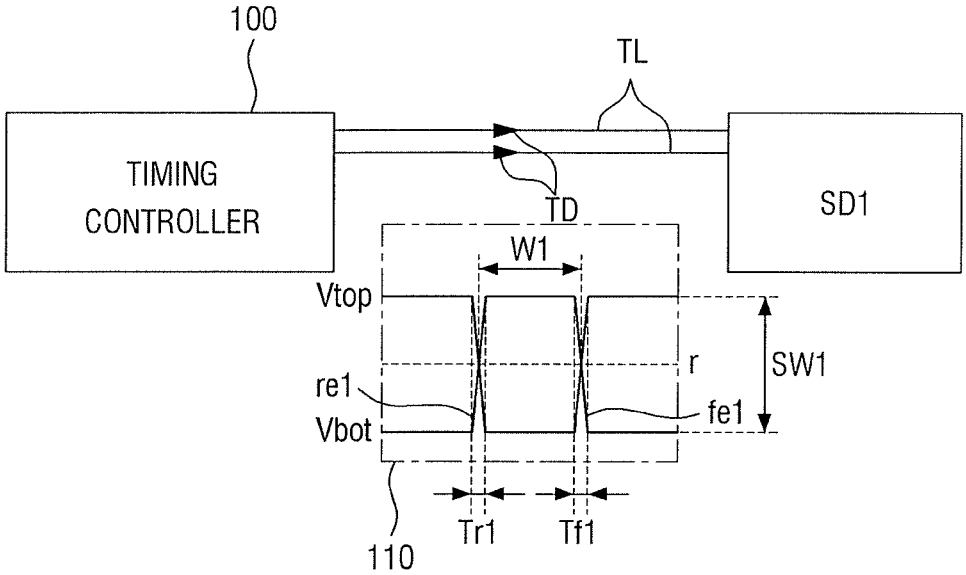
FIG. 5 illustrates an embodiment of a driver receiving the first clock signal.
Figure 6:
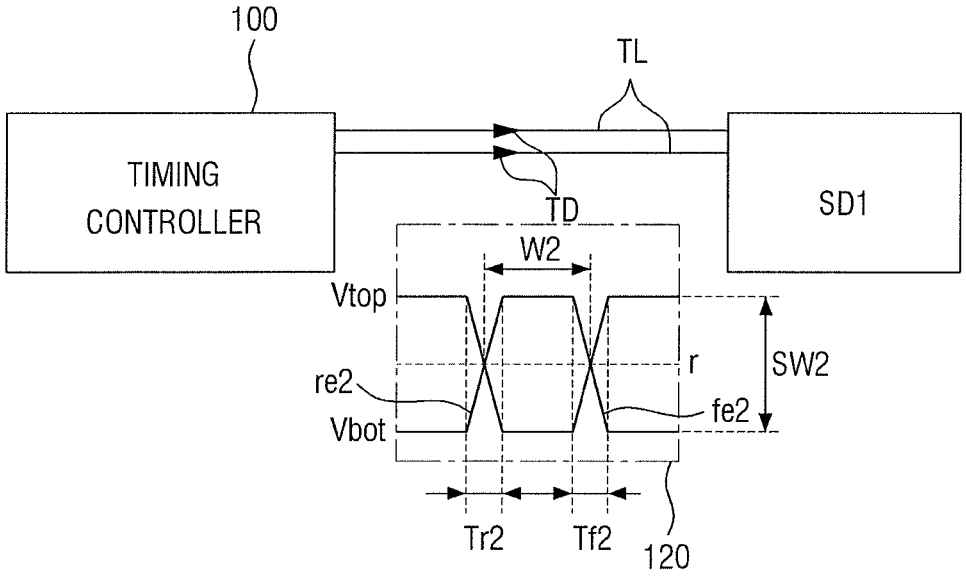
FIG. 6 illustrates an embodiment of a driver receiving a second clock signal.

FIGS. 3 to 6 illustrate embodiments relating to a method for driving a display device. FIG. 3 illustrates an embodiment of a signal transmission method of the display device. FIG. 4 illustrates an embodiment of the first clock signal in FIG. 3. FIG. 5 illustrates an example of the first clock signal provided to the drive circuit unit during a vertical active section. FIG. 6 illustrates an example of the second clock signal provided to the drive circuit unit during a vertical blank section. In FIGS. 3 to 6, the signal transmission method will be described based on the relationship between the timing controller and one source driver in the drive circuit unit.

Referring to FIGS. 3 to 6, each of $1^{st}$ frame and $2^{nd}$ frame may include a vertical active section VA and a vertical blank section VB. The $1^{st}$ frame and the $2^{nd}$ frame may be adjacent to each other, for example, in the sense that similar two frames are not between $1^{st}$ frame and the $2^{nd}$ frame. The vertical blank section VB of the $1^{st}$ frame may be between the vertical active section VA of the $1^{st}$ frame and the vertical active section VA of the $2^{nd}$ frame. The vertical active sections VA and the vertical blank sections VB may be repeated at frame periods.

The timing controller 100 may receive a vertical synchronization signal Vsync from an external source. The vertical synchronization signal Vsync is transmitted at one frame period. Referring to FIG. 3, the vertical active section VA may correspond to a section from a first point (at which the vertical synchronization signal Vsync is converted from a low level to a high level) to a second point at which the vertical synchronization signal Vsync is converted from a high level to a low level again. The vertical blank section VB may correspond to a section from a first point (at which the vertical synchronization signal Vsync is converted from a high level to a low level) to a second point at which the vertical synchronization signal Vsync is converted from a low level to a high level again.

The timing controller 100 may provide transmission data TD to the drive circuit unit 200 during the vertical active section VA and the vertical blank section VB. The timing controller 100 may provide the first clock signal 110 of the transmission data TD during the vertical active section VA. Referring to FIG. 4, the first clock signal 110 may include a plurality of data packets 110*a* and 110*b*. The data packets 110*a* and 110*b* may be provided to a plurality of pixel rows in the corresponding frame.

The data packet 110*a* may include display data DD and clock codes CC1 and CC2. The display data DD may include a plurality of data bits D1 to Dn corresponding to the number of columns of a pixel unit. The clock codes CC1 and CC2 may be periodically added to the display data DD. In an embodiment, the clock codes CC1 and CC2, as shown in FIG. 4, may include two bits of first bit CC1 and second bit CC2. In one embodiment, the clock codes CC1 and CC2 may also include one bit. The arrangement of bits of the data packet 110 is not limited to that shown in FIG. 4. For example, in one embodiment, the data packet 110*a* may include dummy bits and the arrangement of the clock codes CC1 and CC2 the display data DD may be changed.

The drive circuit unit 200 may provide display signals S1 to Sn, generated based on the first clock signal 110, to a plurality of pixel units in the display area DA of the display panel 300 during the vertical active section VA of the 1st frame.

The timing controller 100 may provide the second clock signal 120 to the drive circuit unit 200 during the vertical blank section VB. The rising time Tr1 of the first clock signal 110 is shorter than the rising time Tr2 of the second clock signal 120. The drive circuit unit 200 may provide display signals S1 to Sn, generated based on the second clock signal 120, to a plurality of dummy pixel units in the non-display area NDA of the display panel 300 during the vertical blank section VB of the 1st frame.

FIGS. 5 and 6 illustrate an example of a relationship between the timing controller 100 and the source driver SD1. Referring to FIG. 5, the timing controller 100 may provide the first clock signal 110 to the source driver SD1 through the first signal line TL during the vertical active section VA. The first signal line TL may be, for example, a pair of lines.

The first clock signal 110 may include two signals swinging, such that their phases are symmetrical to each other between the first maximum voltage Vtop and the first minimum voltage Vbot based on the reference voltage r. The two signals may have the same period W1 and swing width SW1 even though they have symmetrical phases. Thus, the timing controller 100 may provide the first clock signal 110 having the two signals to the first signal line TL corresponding to a pair of lines during the vertical active section VA. The first clock signal 110 may have first rising time Tr1 and first falling time Tf1.

Referring to FIG. 6, the timing controller 100 may provide the second clock signal 120 to the source driver SD1 through the first signal line TL during the vertical blank section VB. The second clock signal 120 may include two signals swinging, such that their phases are symmetrical to each other between the first maximum voltage Vtop and the first minimum voltage Vbot based on the reference voltage r. The two signals may have the same period W2 and swing width SW2 even though they have symmetrical phases. Thus, the timing controller 100 may provide the second clock signal 120 having the two signals to the first signal line TL corresponding to a pair of lines during the vertical blank section VB. The second clock signal 120 may have second rising time Tr2 and second falling time Tf2.

In an embodiment, the first clock signal 110 and the second clock signal 120 have the same periods W1 and W2 and swing widths SW1 and SW2. The first rising time Tr1 is shorter than the second rising time Tr2. The first falling time Tf1 is shorter than the second falling Tf2. Therefore, the slew rate of the first clock signal 110 is higher than the slew rate of the second clock signal 120. As a result, the slope of first rising edge re1 of the first clock signal 110 is greater than the slope of second rising edge re2 of the second clock signal 120. Further, the slope of first falling edge fe1 of the first clock signal 110 is greater than the slope of second falling edge fe2 of the second clock signal 120.

Figure 7A:
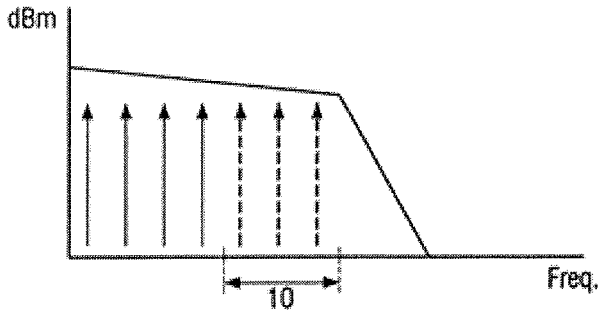
FIGS. 7A-7B illustrate examples of noise reduction effects of a display device.
Figure 7B:
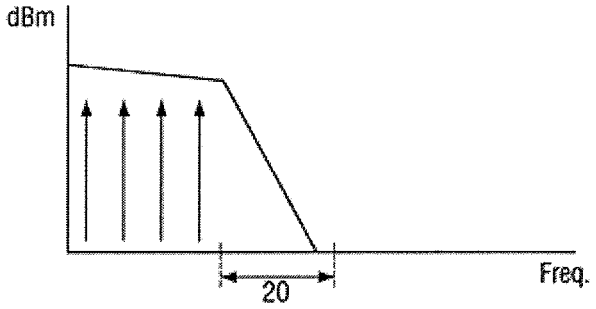

FIGS. 7A and 7B illustrate examples of noise reduction effects of the display device. FIG. 7A illustrates an example of the result of converting the first clock signal 110 to a frequency domain through a Fast Fourier Transform (FFT). FIG. 7B illustrates an example of the result of converting the second clock signal 120 to a frequency domain through a Fast Fourier Transform (FFT).

Referring to FIG. 7A, high frequency components exist in a specific frequency domain 10 in the first clock signal 110. Referring to FIG. 7B, high frequency components are removed in a specific frequency domain 20 in the second clock signal 120. Thus, the RF noise of the second clock signal 120 is reduced compared to the RF noise of the first clock signal 110. The degree of reduction of RF noise of the second clock signal 120 having a lower slew rate than the first clock signal 110 may therefore be improved compared to the degree of reduction of RF noise of first clock signal 110.

The timing controller 100 may prevent deterioration of signal integrity by providing the second clock signal 120 having a lower slew rate than the first clock signal 110 to the drive circuit unit 200 during the vertical active section VA. Thus, in at least one embodiment of the display device, the vertical active section VA and the vertical blank section VB are separated, and clock signals having different slew rates are provided to the drive circuit unit 200. In one embodiment, the timing controller 100 may provide the first clock signal 110 having a relatively high slew rate to the drive circuit unit 200 during the vertical active section VA, and the timing controller 100 may provide the second clock signal 120 having a relatively low slew rate to the drive circuit unit 200 during the vertical blank section VB.

Thus, according to an embodiment, the display device may reduce RF noise while maintaining signal integrity. Moreover, the display device may reduce power consumption by providing the second clock signal 120 having a relatively low slew rate to the drive circuit unit 200 during the vertical blank section, in which display data DD is not input in the display area DA.

Figure 8:
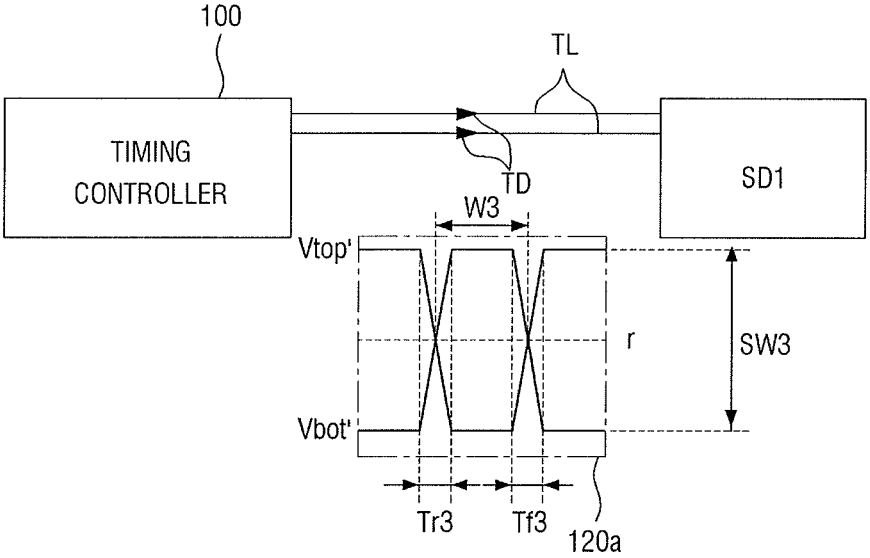
FIGS. 8 to 10 illustrate additional examples of a second clock signal.
Figure 9:
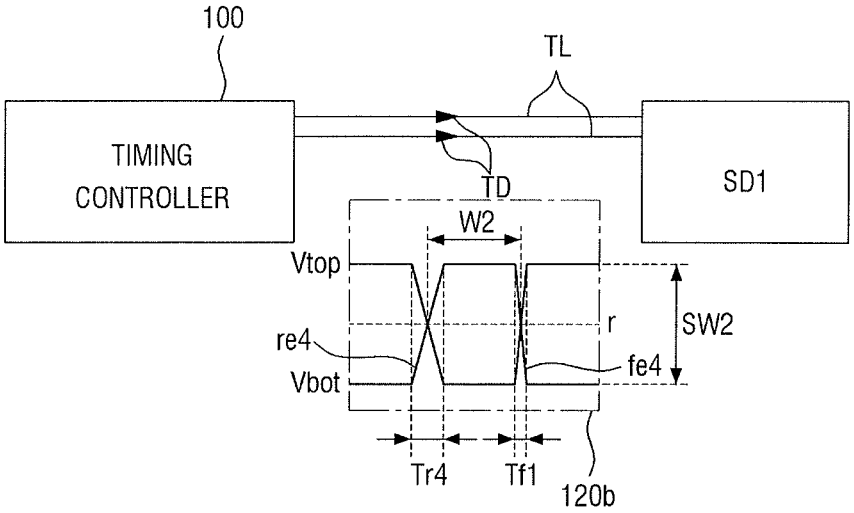
Figure 10:
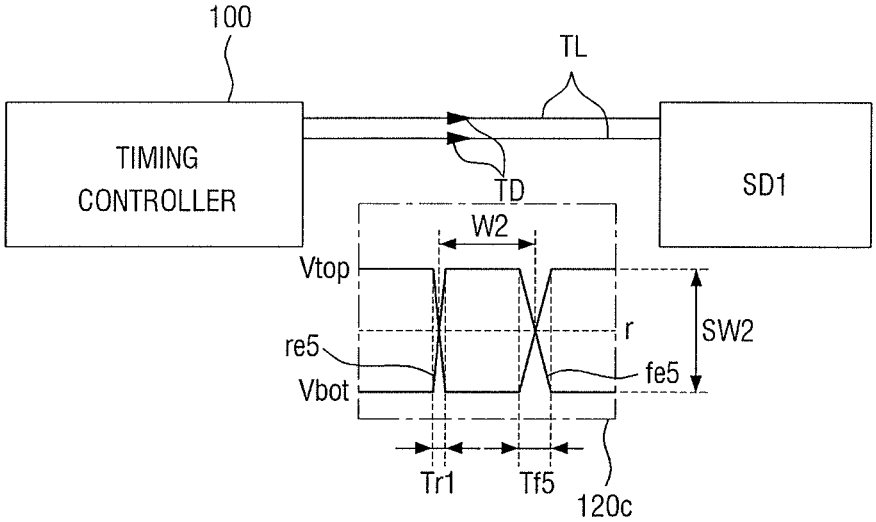

FIGS. 8 to 10 illustrate additional examples of the second clock signal provided to the drive circuit unit during the vertical blank section. Referring to FIG. 8, the timing controller 100 may provide a third clock signal 120*a* to the source driver SD1 through the first signal line TL during the vertical blank section VB. The third clock signal 120*a* may include two signals swinging, such that their phases are symmetrical to each other between the maximum voltage Vtop' and the minimum voltage Vbot' based on the reference voltage r. The voltage level of the maximum voltage Vtop' may be higher than the voltage level of the maximum voltage Vtop in FIG. 5. The voltage level of the minimum voltage Vbot' may be lower than the voltage level of the minimum voltage Vbot in FIG. 5. For example, the change in voltage level from the minimum voltage Vbot' to the maximum voltage Vtop' (or the change in voltage level from the maximum voltage Vtop' to the minimum voltage Vbot') is greater than the change in voltage level from the minimum voltage Vbot to the maximum voltage Vtop (or the change in voltage level from the maximum voltage Vtop to the minimum voltage Vbot), illustrated in FIG. 5. The swing width SW3 of the third clock signal 120*a* may be relatively large compared to that of the first clock signal 110. However, the period W3 of the third clock signal 120*a* may be equal to the period W1 of the first clock signal, and the third rising time Tr3 of the third clock signal 120*a* may be longer than the first rising time Tr1 of the first clock signal 110.

The slew rate of the third clock signal 120*a* may be lower than the slew rate of the first clock signal 110. Therefore, the change in voltage level from the minimum voltage Vbot' to the maximum voltage Vtop' and the third rising time Tr3 may be different from FIG. 8 in another embodiment, as long as the slew rate of the third clock signal 120*a* is lower than the slew rate of the first clock signal 110.

Referring to FIGS. 5, 9 and 10, the timing controller 100 may adjust at least one of the first rising time Tr1 or first falling time Tf1 of the first clock signal 110 to generate a fourth clock signal 120*b*. Referring to FIG. 9, the timing controller 100 may change the first rising time Tr1 of the first clock signal 110 into a fourth rising time Tr4, so that the length of the first rising time Tr1 is equal to the length of the fourth rising time Tr4, but the length of the first falling time Tf1 of the first click signal 110 may not change. For example, the timing controller 100 may generate the fourth clock signal 120*b*, in which the slope of the fourth rising edge re4 and the slope of the fourth falling edge fe4 are different from each other, during the vertical blank section VB. The fourth clock signal 120*b* may be output to the drive circuit unit 200.

In contrast, the timing controller 100 may change the first falling time Tf1 of the first clock signal 110 into a fifth falling time Tf5, so that the length of the first rising time Tr1 is equal to the length of the fifth falling time Tf5, but the length of the first rising time Tr1 of the first click signal 110 may not change. Referring to FIG. 10, the timing controller 100 may generate a fifth clock signal 120*c*, in which the slope of the fifth rising edge re5 and the slope of the fifth falling edge fe5 are different from each other, during the vertical blank section VB. The fifth clock signal 120*c* may be output to the drive circuit unit 200.

The timing controller 100 may change the lengths of the first rising time Tr1 and first falling time Tf1 of the first clock signal 110, and may generate a clock signal in which the length of the changed first rising time Tr1 and the length of the changed first falling time Tf1 are different from each other.

Figure 11:
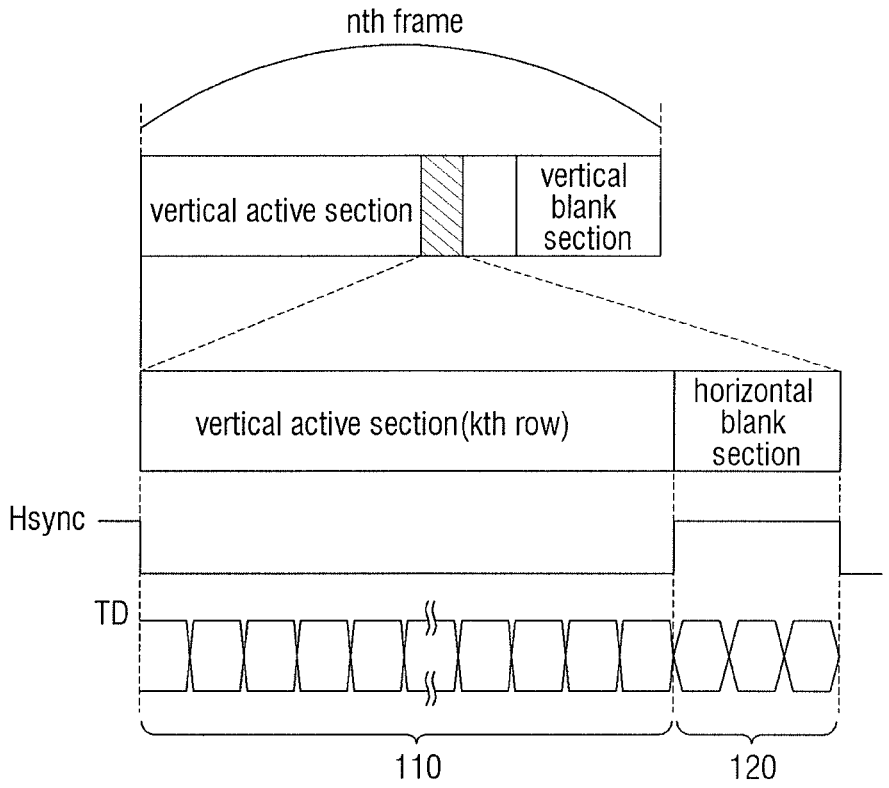
FIG. 11 illustrates another embodiment of a signal transmission method.

FIG. 11 illustrates another embodiment of a signal transmission method of a display device. Referring to FIG. 11, the timing controller 100 may provide the first clock signal 110 to the drive circuit unit 200 during the horizontal active section HA. The timing controller 100 may provide the second clock signal 120 to the drive circuit unit 200 during the horizontal blank section HB adjacent to the horizontal active section HA. In an embodiment, the timing controller 100 may change at least one of the lengths of the first rising time Tr1 or first falling time Tf1 of the first clock signal 110 to generate the second clock signal 120.

In one embodiment, the vertical active section VA in the nth frame may include a plurality of horizontal active sections HA and a plurality of horizontal blank sections HB. The horizontal active section HA and the horizontal blank section HB may correspond to a horizontal synchronization signal Hsyn in which one pixel row of the display panel 300 is set to a period. A case of the kth pixel row of the $1^{st}$ to nth pixel units in the display area DA will be illustratively described.

The timing controller 100 may externally receive a horizontal synchronization signal Hsync. Referring to FIG. 11, the horizontal active section HA may be a section from a first point (at which the horizontal synchronization signal Hsync is converted from a high level to a low level) to a second point at which the horizontal synchronization signal Hsync is converted from a low level to a high level again. The horizontal blank section HB may be a section from a first point (at which the horizontal synchronization signal Hsync is converted from a low level to a high level) to a second point at which the horizontal synchronization signal Hsync is converted from a high level to a low level again.

The timing controller 100 may provide transmission data TD to the drive circuit unit 200 during the vertical active section VA and the vertical blank section VB. However, the timing controller 100 may provide the first clock signal 110 of the transmission data TD during the vertical active section VA. Referring to FIG. 4, the first clock signal 110 may include a plurality of data packets 110*a* and 110*b*. The data packets 110*a* and 110*b* may be provided to a plurality of pixel rows in the corresponding frame.

The timing controller 100 may provide the first clock signal 110 to the drive circuit unit 200 during the horizontal active section HA. The timing controller 100 may provide the second clock signal 120 to the drive circuit unit 200 during the horizontal blank section HB. The rising time Tr1 of the first clock signal 110 is shorter than the rising time Tr2 of the second clock signal 120. The period and swing width of the first clock signal may be equal to each other. Therefore, the slew rate of the first clock signal 110 may be higher than the slew rate of the second clock signal 120.

In one embodiment, the horizontal active section HA and the horizontal blank section HB are separated, the timing controller 100 may provide the first clock signal 110 having first rising time Tr1 to the drive circuit unit 200 during the horizontal active section HA, and the timing controller 100 may provide the second clock signal 120 (having second rising time Tr2 longer than the first rising time Tr1) to the drive circuit unit 200 during the horizontal blank section HB. Thus, the display device may reduce RF noise while maintaining signal integrity.

Figure 12:
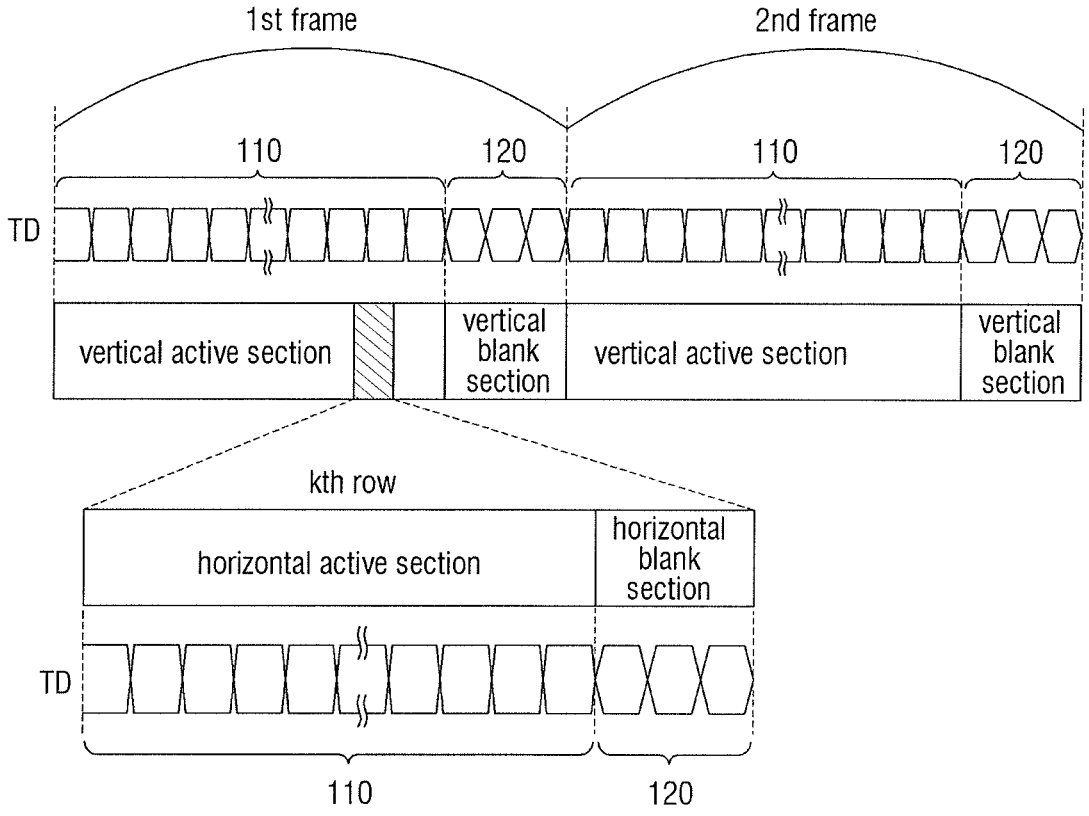
FIGS. 12 to 13 illustrate another embodiment of a signal transmission method.
Figure 13:
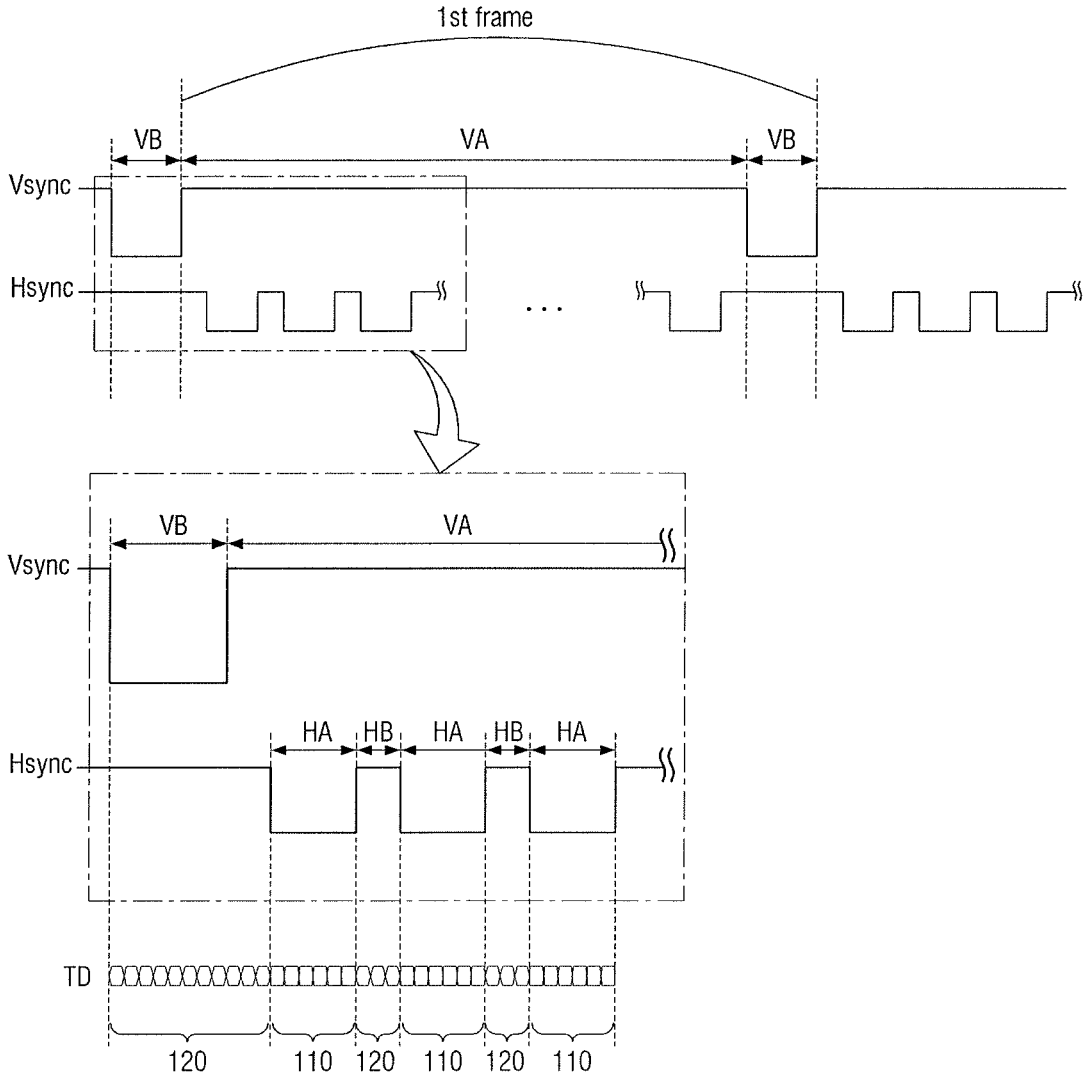

FIGS. 12 and 13 illustrates another embodiment of a signal transmission method of a display device. Referring to FIGS. 12 and 13, all of the vertical active section VA, vertical blank section VB, horizontal active section HA, and horizontal blank section HB may be considered.

For example, the timing controller 100 may provide the first clock signal 110 to the drive circuit unit 200 only during a section in which the vertical active section VA overlaps the horizontal active section HA. For example, the timing controller 100 provide the second clock signal 120 to the drive circuit unit 200 during the vertical active section VA overlapping the horizontal blank section HB. Thus, the timing controller 100 may divide one vertical active section into a horizontal active section HA and a horizontal blank section HB according to a horizontal synchronization Hsync. The timing controller 100 may provide the first clock signal 110 having relatively short rising time to the drive circuit unit 200 during a section in which the vertical active section VA overlaps the horizontal active section HA. In contrast, the timing controller may provide the second clock signal 120 having relatively long rising time to the drive circuit unit 200 during a section in which the vertical active section VA overlaps the horizontal blank section HB.

Figure 14:
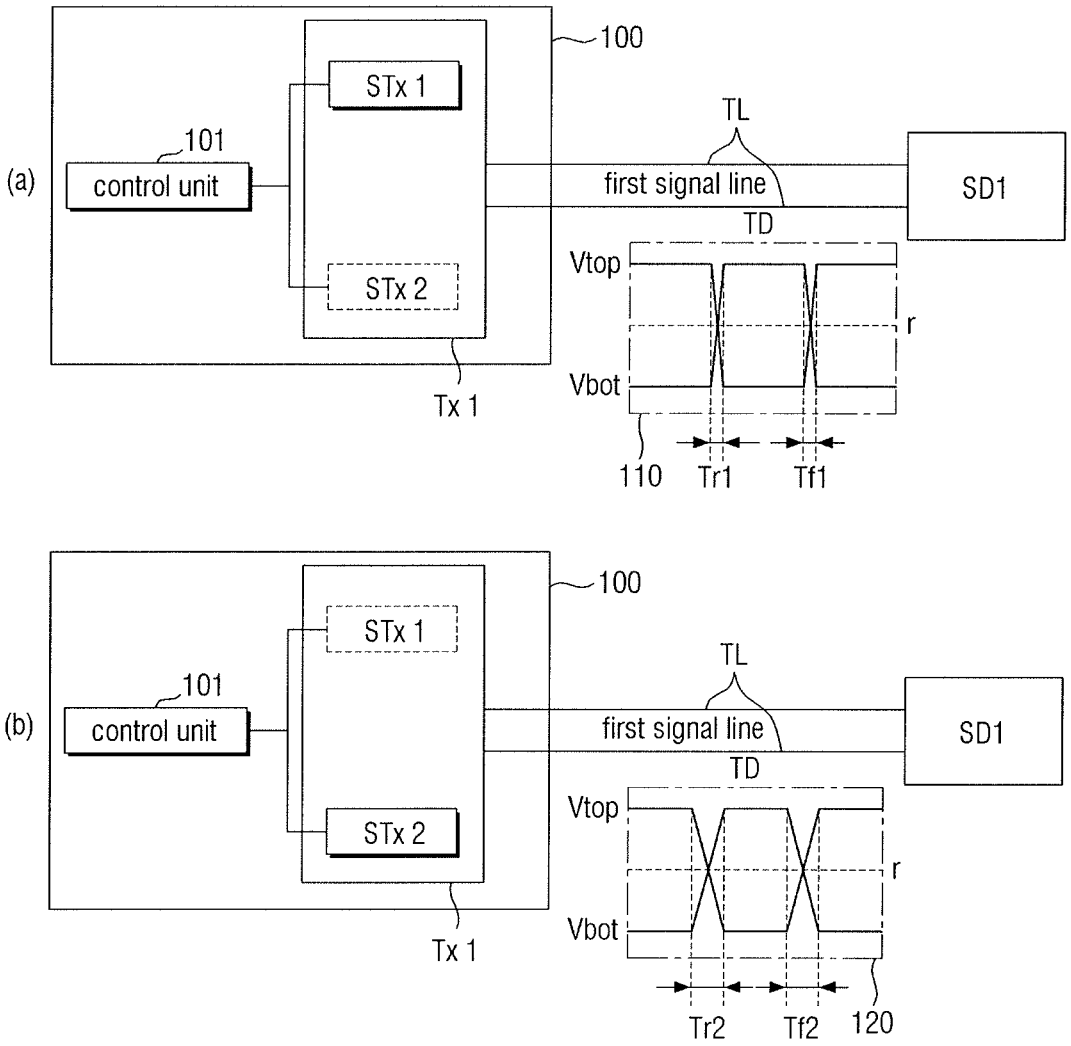
FIGS. 14 to 15A-15C illustrate other embodiments of a signal transmission method.

FIGS. 14 to 15 other embodiment of signal transmission methods between the timing controller and the drive circuit unit in the display device. However, in FIG. 5, the signal transmission method will be described based on the relationship between the timing controller 100 and one source driver in the drive circuit unit 200.

Referring to FIG. 14A, the timing controller 100 may include a control unit 101 and a first output unit Tx1. The control unit 101 may control the output of the first output unit Tx1 based on externally received signals. The first output unit Tx1 may be connected with a first driver SD1 through a first signal line TL. The first output unit Tx1 may include a first sub-output unit STx1 and a second sub-output unit STx2. The first sub-output unit STx1 and the second sub-output unit STx2 may output clock signals having different rising times from each other to the first signal line TL.

The first sub-output unit STx1 may output a first clock signal 110 having first rising time Tr1 and first falling time Tf1. The second sub-output unit STx2 may output a second clock signal 120 having second rising time Tr2 and second falling time Tf2. The first rising time Tr1 is shorter than the second rising time Tr2. The first falling time Tf1 is shorter than the second falling time Tf2. Thus, the timing controller 100 may be configured such that one output unit includes two sub-output units, and the sub-output units respectively output clock signals having different rising times (or falling times) from each other.

Figure 15A:
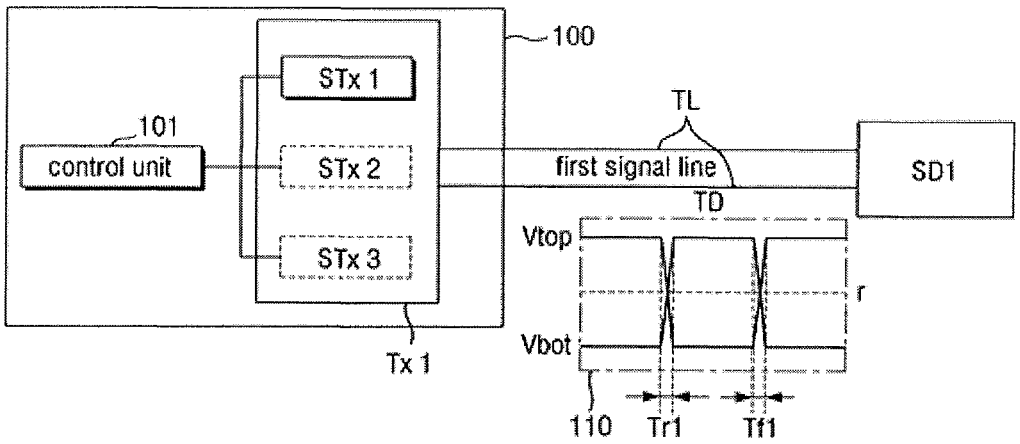
Figure 15B:
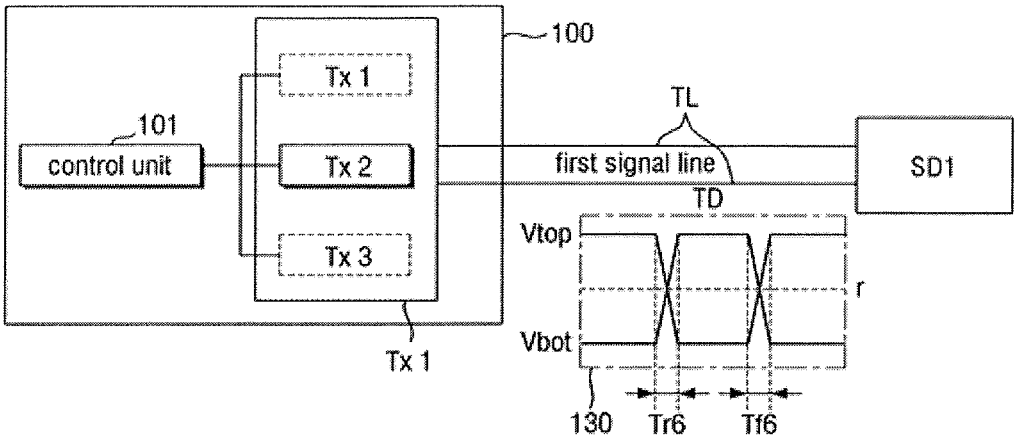
Figure 15C:
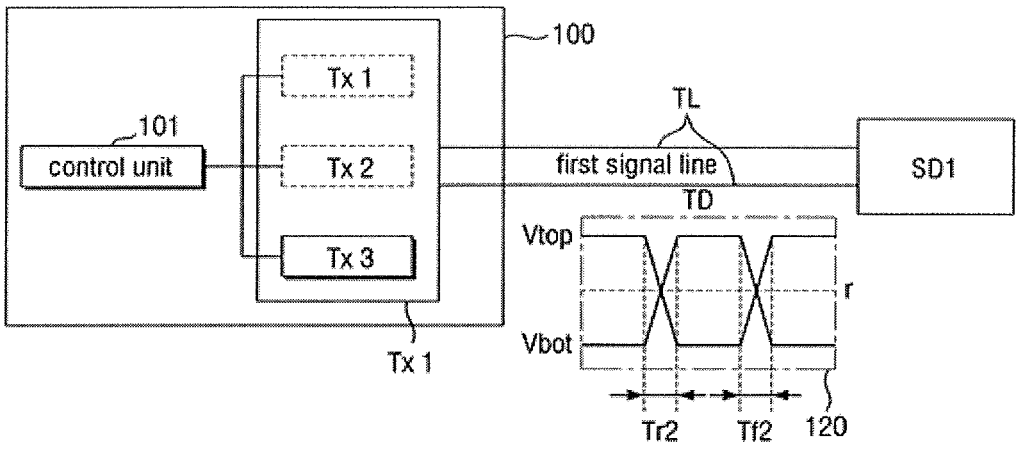

Referring to FIGS. 15A to 15*c*, the timing controller 100 may include the control unit 101 and the first output unit Tx1. The first output unit Tx1 may further include a third sub-output unit STx3 which outputs a sixth clock signal 130 having sixth rising time Tr6 and sixth falling time Tf6. The sixth rising time Tr6 is longer than the first rising time Tr1 and is shorter than the second rising time Tr2. Further, the sixth falling time Tf6 is longer than the first falling time Tf1 and is shorter than the second falling time Tf2.

The control unit 101 may control the output of a clock signal from one of the first to third sub-output units STx1, STx2 and STx3. For example, in the case of FIG. 15A, the control unit 101 may control the output of the first clock signal 110 from the first sub-output unit STx1. In the case of FIG. 15B, the control unit 101 may control the output of the second clock signal 120 from the second sub-output unit STx2. In the case of FIG. 15C, the control unit 101 may control the output of the sixth clock signal 130 from the second sub-output unit STx2. Thus, the first output unit Tx1 of the timing controller 100 may further include a third sub-output unit outputting the sixth clock signal 130 having the sixth rising time Tr6 and the sixth falling time Tf6.

The timing controller 100 may provide clock signals different from each other to a source driver through a plurality of sub-output units generating clock signals having rising times different from each other. The number of sub-output units may be different from those in FIGS. 15A-15C in another embodiment.

Figure 16:
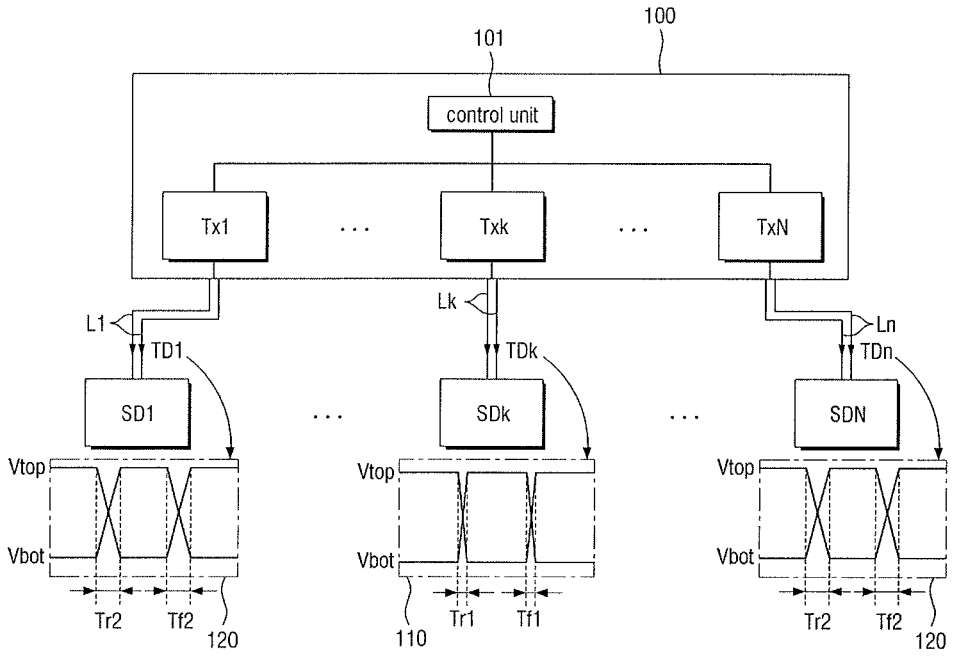
FIG. 16 illustrates another embodiment of a signal transmission method.

FIG. 16 illustrate another embodiment of a signal transmission method between the timing controller and the drive circuit unit in the display device. Referring to FIG. 16, the timing controller 100 may include a control unit 101 and 1st to nth output units (Tx1 to TxN, N is a natural number of 3 or more). The control unit 101 may control the output of the 1st to nth output units Tx1 to TxN. Further, the drive circuit unit 200 may include 1st to nth source drivers, where SD1 to SDN, N is a natural number of 3 or more. In an embodiment, the 1st to nth output units Tx1 to TxN may be respectively connected with the 1st to nth source drivers SD1 to SDN in a one to one. The kth output unit (Txk, $1<k<n$) may be connected with the kth driver SDK.

Referring to FIG. 16, the kth output unit Txk may be located between the first output unit Tx1 and the nth output unit TxN. The first output unit Tx1 and the nth output unit TxN will be illustratively described.

The first output unit Tx1 may be connected with the first source driver SD1 through a first line L1. The kth output unit Txk may be connected with the kth source driver SDk through a kth line Lk. The first line L1 may be longer than the kth line Lk. Thus, the resistance of the first line L1 itself may be greater than the resistance of the kth line Lk itself. As a result, the signal provided through the first line L1 is relatively greatly influenced by noise compared to the signal provided through the kth line Lk.

Therefore, the first output unit Tx1 may provide the second clock signal 120 having the second rising time Tr2 to the first source driver SD1. The kth output unit Txk may provide the first clock signal 110 having the first rising time Tr1 to the kth source driver SDk. The first rising time Tr1 is shorten than the second rising time Tr2. As a result, the second clock signal 120 is strong to noise compared to the first clock signal 110 (e.g., refer to FIG. 7). In one embodiment, the first falling time Tf1 of the first clock signal 110 may be shorter than the second falling time Tf2 of the second clock signal 120. The timing controller may reduce or minimize the noise effects due to resistance components depending on the line length, by changing the rising time (or falling time) of the clock signal depending on the distance between the output unit and the source driver.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controllers, drivers, units, and the other processing features of the embodiments described herein may be implemented in logic which, for example, may include hardware, software, or both. When implemented at least partially in hardware, the controllers, drivers, units, and other processing features may be, for example, integrated circuits including but not limited to an application-specific integrated circuit, a field-programmable gate array, a combination of logic gates, a system-on-chip, a microprocessor, or another type of processing or control circuit.

When implemented in at least partially in software, the controllers, drivers, units, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless specifically indicated. Accordingly, it will be understood by those of skill in the art that various changes in form and details may be made without departing from the spirit and scope of the present invention as set forth in the following claims.

What is claimed is:

1. A display device, comprising:

a timing controller to output a first clock signal having first rising time during an active section and a second clock signal having second rising time during a blank section adjacent to the active section;

a driver to generate a data signal based on the first clock signal and the second clock signal and to output the data signal; and a display panel to display an image based on the data signal, wherein the first rising time is shorter than the second rising time.

2. The display device as claimed in claim 1, wherein a slew rate of the first clock signal is greater than the slew rate of the second clock signal.

3. The display device as claimed in claim 1, wherein:

the first clock signal has a first falling time, the second clock signal has a second falling time, and the first falling time is shorter than the second falling time.

4. The display device as claimed in claim 1, wherein:

the first clock signal has a first maximum voltage and a first minimum voltage lower than the first maximum voltage, the second clock signal has a second maximum voltage and a second minimum voltage lower than the second maximum voltage, the first maximum voltage is lower than the second maximum voltage, and the first minimum voltage is lower than the second minimum voltage.

5. The display device as claimed in claim 1, wherein the display panel includes a display area to display an image and a non-display area outside the display area.

6. The display device as claimed in claim 5, wherein:

the display area includes 1st to nth pixel rows (n is a natural number of 2 or more), and the active section is a vertical active section in which the data signal is input to the 1st to nth pixel rows.

7. The display device as claimed in claim 5, wherein:

the display area includes 1st to nth pixel columns (n is a natural number of 2 or more), and the active section is a horizontal active section in which the data signal is input to the 1st to nth pixel columns.

8. The display device as claimed in claim 1, wherein the timing controller is to change the first rising time to generate the second clock signal when the active section is converted to the blank section.

9. The display device as claimed in claim 1, wherein:

the timing controller includes a first output and a second output connected with the driver, the first output is to provide the first clock signal to the driver during the active section, and the second output is to provide the second clock signal to the driver during the blank section.

10. A display device, comprising:

a display panel including a display area to display an image and a non-display area outside the display area;

a driver connected with the display panel through a plurality of signal lines; and a time controller to provide a first clock signal to the driver during an active section and a second clock signal to the driver during a blank section adjacent to the active section, wherein the driver is to provide a data signal generated based on the first clock signal and the second clock signal to the signal lines during the active section, and wherein a slew rate of the first clock signal is greater than a slew rate of the second clock signal.

11. The display device as claimed in claim 10, wherein a rising time of the first clock signal is shorter than the rising time of the second clock signal.

12. The display device as claimed in claim 10, wherein the driver is to provide a dummy data signal generated based on the first clock signal and the second clock signal to the non-display area during the blank section.

13. The display device as claimed in claim 10, wherein:

the display area includes 1st to nth pixel rows (n is a natural number of 2 or more), and the active section is a vertical active section in which the data signal is input to the 1st to nth pixel rows.

14. The display device as claimed in claim 10, wherein:

the display area includes 1st to nth pixel columns (n is a natural number of 2 or more), and the active section is a horizontal active section in which the data signal is input to the 1st to nth pixel columns.

15. The display device as claimed in claim 10, wherein the timing controller is to adjust a slew rate of the first clock signal to generate the second clock signal when the active section is converted to the blank section.

16. The display device as claimed in claim 10, wherein:

the timing controller includes a first output and a second output connected with the driver, the first output is to provide the first clock signal to the driver during the active section, and the second output is to provide the second clock signal to the driver during the blank section.

17. The display device as claimed in claim 10, wherein:

the first clock signal has a first maximum voltage and a first minimum voltage lower than the first maximum voltage, the second clock signal has a second maximum voltage and a second minimum voltage lower than the second maximum voltage, the first maximum voltage is lower than the second maximum voltage, and the first minimum voltage is lower than the second minimum voltage.

18. A method for driving a display device, comprising:

providing a first clock signal having a first rising time to a driver during an active section in which a data signal displaying an image is input; and providing a second clock signal having a second rising time to the driver during a blank section located adjacent to the active section, wherein the first rising time is shorter than the second rising time.

19. The method as claimed in claim 18, wherein a slew rate of the first clock signal is greater than a slew rate of the second clock signal.

20. The method as claimed in claim 18, wherein:

the first clock signal has a first maximum voltage and a first minimum voltage lower than the first maximum voltage, the second clock signal has a second maximum voltage and a second minimum voltage lower than the second maximum voltage, the first maximum voltage is lower than the second maximum voltage, and the first minimum voltage is lower than the second minimum voltage.

* * * * *